United States Patent [19]

Woltjen

[11] 4,172,738

[45] Oct. 30, 1979

[54] APPARATUS AND METHOD FOR REMOVING RESIDUAL OIL FROM AUTOMOBILE ENGINES

[76] Inventor: John T. Woltjen, 1507 N. Elston, Chicago, Ill. 60622

[21] Appl. No.: 851,367

[22] Filed: Nov. 14, 1977

[51] Int. Cl.[2] ..... B08B 7/04; F16N 31/00

[52] U.S. Cl. ..... 134/18; 123/198 DA; 134/42; 184/1.5

[58] Field of Search ..... 134/18, 42, 115 R, 186, 134/201; 184/1.5; 210/416 L; 123/198 DA, 198 R

[56] References Cited

U.S. PATENT DOCUMENTS 3,140,699 7/1964 Rassushin ..... 123/198 R

OTHER PUBLICATIONS

"Easy Oil Changes for your Car", *Popular Mechanics,* Jun. 1975, p. 38.

*Primary Examiner*—Richard V. Fisher
*Attorney, Agent, or Firm*—Michael G. Berkman

[57] ABSTRACT

Apparatus and method for removing dirty residual oil remaining in an automobile engine after its crankcase has been drained by conventional procedures. The apparatus of the invention comprises an adapter including a gasket for shunting oil away from a first conduit; a duct for delivering residual oil away from the conduit and into a receptacle below the engine; and an opening threaded to mate with an oil filter support post. After draining crankcase oil, the oil filter is removed and the ignition coil is disconnected to prevent ignition. The adapter is then attached to the oil filter support post, and the crankcase is filled with clean oil. The engine is cranked to operate its oil pump, and dirty residual oil held in the first conduit is expelled through the adapter and collected until clean oil appears.

5 Claims, 8 Drawing Figures

APPARATUS AND METHOD FOR REMOVING RESIDUAL OIL FROM AUTOMOBILE ENGINES

BACKGROUND OF THE INVENTION

Various types of apparatus and procedures for draining dirty oil from automobile engines are known in the prior art. However, the prior art apparatus suffers from being too complex and too expensive for use by average motorists who drain their own engine oil and replace oil filters. Motorists not having the benefit of such complex apparatus are faced with the prospect of recirculating ½ to ¾ quart of the dirtiest oil remaining in their engines after an oil and filter change.

It is a principal object of the present invention to provide a simple and inexpensive adapter for facilitating removal of residual oil remaining in an automobile engine after crankcase oil has been drained by conventional procedures.

It is a related object of the invention to prevent spillage of residual oil accompanying discharge of such oil from an automobile engine using an adapter of the invention.

Another object of the invention is to provide a method, using the adapter of the invention, for draining about ½ to ¾ quart (depending upon size of the engine) of additional dirty residual oil after oil has been drained from the crankcase of an automobile engine by conventional procedures.

Additional objects and advantages of the present invention will become apparent to persons skilled in the art from the following specification, taken in conjunction with the drawings.

DESCRIPTION OF A PREFERRED EMBODIMENT

Figure 1:
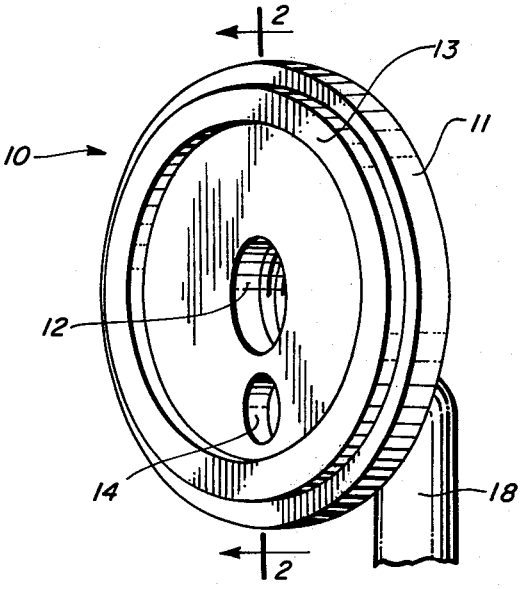
FIG. 1 is a rear perspective view of an adapter of the invention.

Referring to FIG. 1, on adapter 10 of the invention includes a cylindrical metal plate 11 formed with a central through bore 12. A circular rubber gasket 13 adheres to an internal surface of the metal plate 11. In the preferred embodiment illustrated the plate 11 is three inches in diameter and has a thickness of ⅛ inch. The plate 11 also defines a second, off-center through opening 14.

Figure 2:
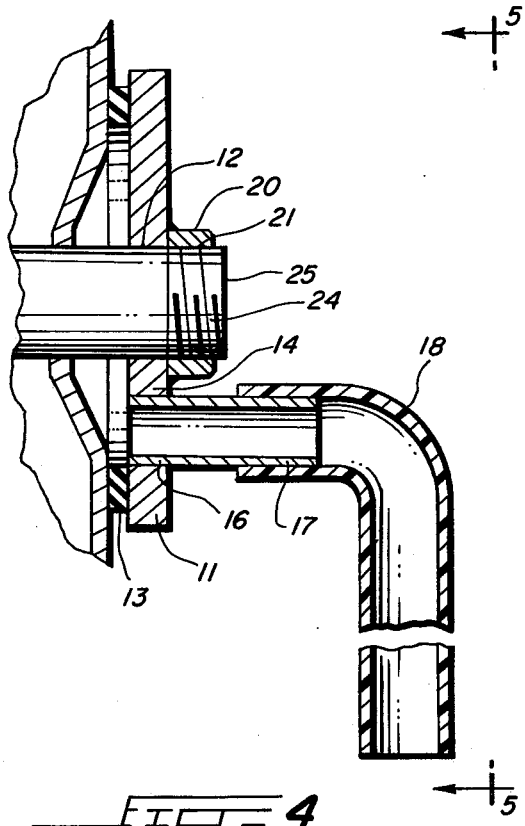
FIG. 2 is an enlarged fragmentary cross-sectional view taken along the lines 2—2 of FIG. 1, showing an adapter of the invention attached to an oil filter support post of an automobile engine.
Figure 3:
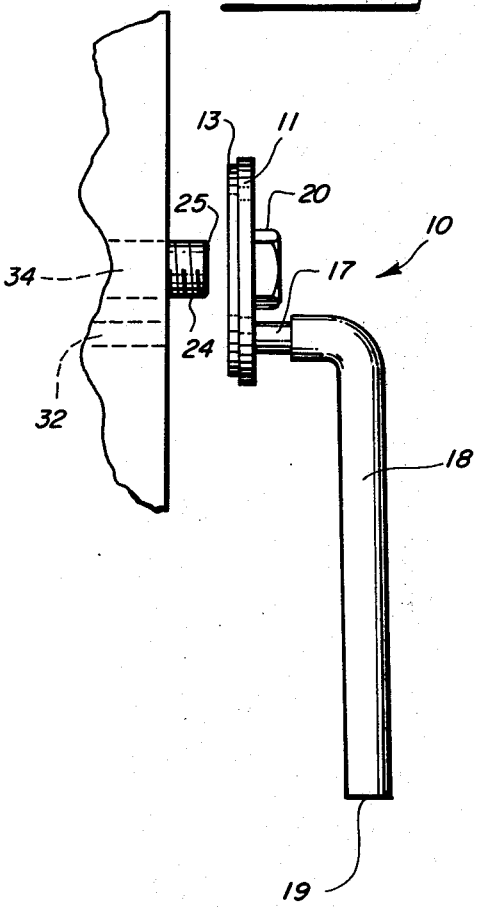
FIG. 3 is a side elevational view of the adapter and oil filter support post of FIG. 2.
Figure 4:
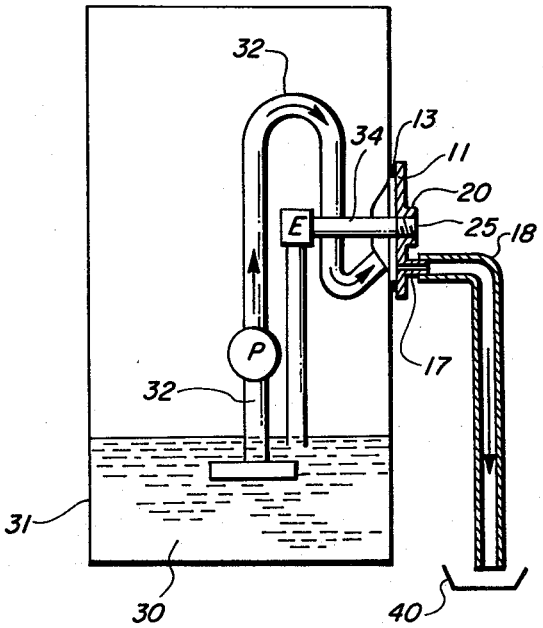
FIG. 4 is a schematic diagram illustrating the method for draining residual oil of the invention.
Figure 5:
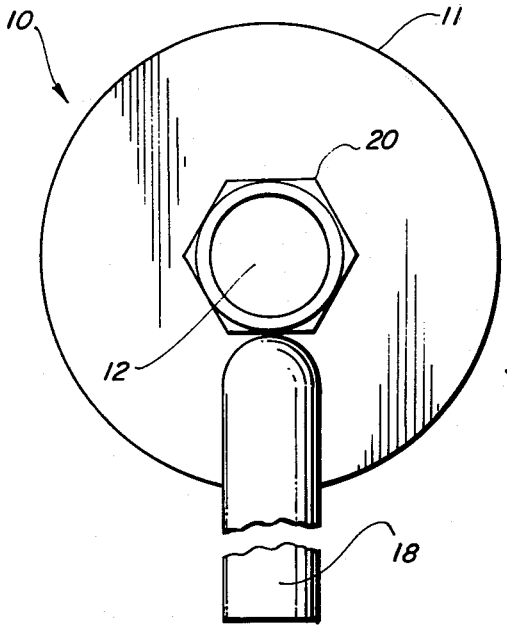
FIG. 5 is a front elevational view of the adapter of the invention.

Referring now to FIGS. 2, 3 and 5 it will be seen that a metal tube 16 is inserted in the eccentric opening 14 and has an outer segment 17 extending outwardly thereof. A flexible plastic hose 18 is telescoped over this segment 17 to provide a fluid-tight fit. The hose 18 is six feet long and either has a distal free end 19 or is coupled to a resealable plastic bag 19*a* (shown in FIG. 3) having a capacity of approximately one quart.

A nut 20 is welded to an external surface of the metal plate 11. The nut 20 is formed with internal screw threads 21 adapted to mate with corresponding threads 24 on an oil filter support post 25, shown in FIGS. 2 and 3. Alternatively, this nut 20 may be omitted and the bore 12 provided with screw threads (not illustrated).

Figure 6:
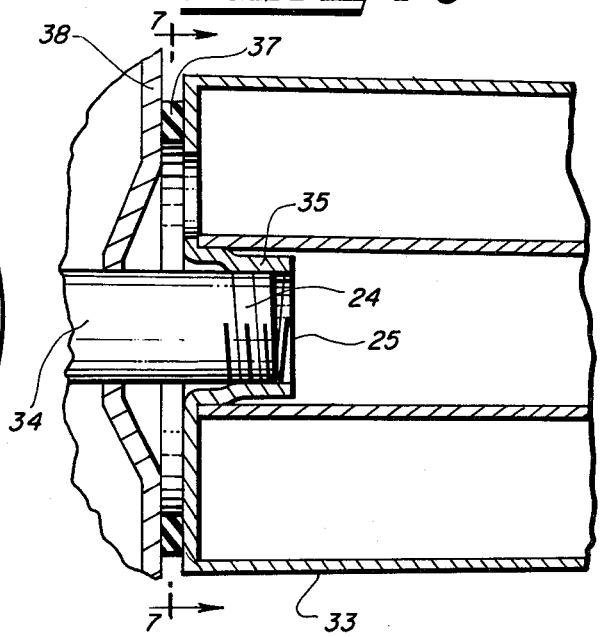
FIG. 6 is a fragmentary side cross-sectional view of an oil filter attached to an oil filter support post in the automobile of FIG. 2.
Figure 7:
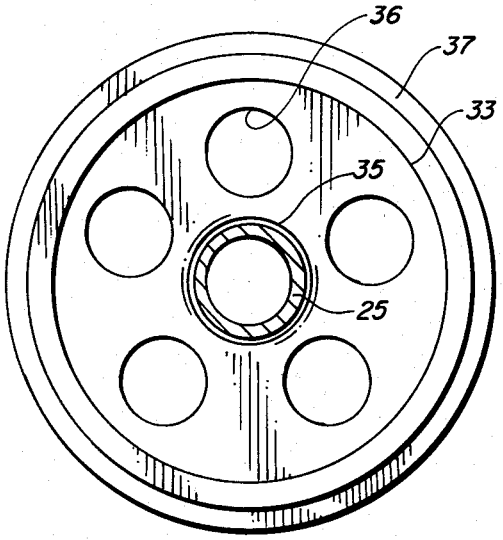
FIG. 7 is a rear elevational view of an oil filter installed in the automobile of FIG. 6 taken along the lines 7—7.
Figure 8:
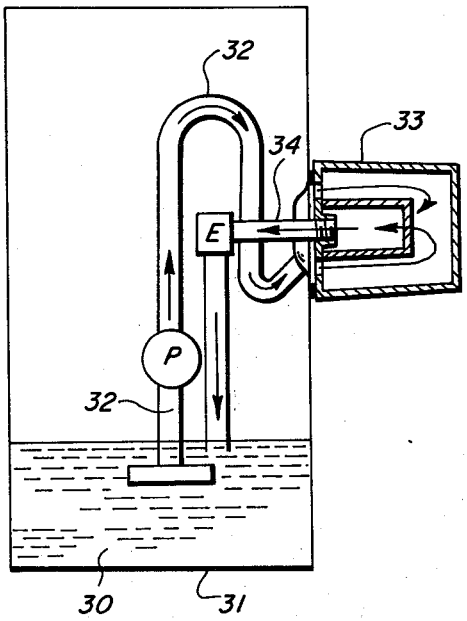
FIG. 8 is a schematic diagram illustrating normal flow of oil in the automobile of FIGS. 6 and 7.

Normal circulation of oil through the lubrication system of an automobile is illustrated schematically in FIGS. 6–8. Crankcase oil 30 is stored in a reservoir or pan 31. A first conduit or conduit means 32 connects this reservoir 31 to an oil filter 33. An oil pump P drives oil from the reservoir 31 to the oil filter 33 and then through a second conduit or conduit means 34 to the engine E before returning to the reservoir 31.

The oil filter 33 defines a screw threaded central internal opening 35 adapted to mate with corresponding threads 24 on the oil filter support post 25. Oil is delivered through the first conduit 32 to five cylindrical openings 36 in the filter 33. A rubber gasket 37 is interposed between the filter 33 and a wall 38 to prevent oil leakage. Oil is delivered from the filter 33 to the engine compartment E through a through bore in the support post 25 communicating with the second conduit 34.

The method of the invention is practiced by first draining the oil reservoir 31 using traditional techniques to discharge old oil 30. Secondly, the oil filter 33 is removed from its support post 25 to expose a distal opening of the first conduit 34, as shown in FIG. 3. An adapter 10 is fastened onto the support post 25 until the gasket 13 forms a fluid-tight seal against a wall 38. The adapter 10 and its accompanying gasket 13 form a shunt or shunt means for directing oil expelled from the first conduit 34 into the tube 17 and hose 18.

Next, the ignition circuit is interrupted by disconnecting the coil, and the reservoir 31 is filled with clean oil 30. The starter motor is then turned on to crank the engine several times and to operate the oil pump P. Dirty residual oil is expelled through the tube 17 in the adapter 10 and collected in a tray 40 beneath the automobile until clean oil first appears. Alternatively, a resealable and disposable one-quart plastic bag may be attached to the distal end 19 of the hose 18 for collection of the old oil. After the starter motor is turned off the adapter 10 is disconnected and a new oil filter is installed. The coil is reconnected, and additional oil is poured into the reservoir to bring the oil up to an appropriate level.

Tests have demonstrated that the method of the invention is effective to remove about ½ to ¾ quart of dirty residual oil remaining in the engine after an ordinary oil and filter change. The precise volume of residual oil removed varies according to size of the engine. This oil contains a very high proportion of contaminants. Because new changed oil contains fewer contaminants when the adapter of the invention is used, the automobile engine literally stops wearing itself out. Oil added to engines after expulsion of this addtional contaminated oil has been observed to retain its light green color several thousand miles after an oil change.

Most internal combustion engines tend to accumulate sludge on the floor of the valve compartment, on the valve cover, and in the oil pan. The buildup is so great at times that returns in the valve compartment are clogged, making it impossible for tappet lubricating oil to return to the crankcase. This, in turn, causes a breakdown of the system and costly engine repairs. By using the apparatus and method of the present invention sludge buildup is eliminated, thereby eliminating problems accruing from that buildup.

The foregoing description of my invention has been made with reference to a preferred embodiment, and numerous changes therein will occur to persons skilled in the art. For example, the adapter 10 must be manufactured in several different sizes and shapes to fit the support posts 25 of various makes and models of automobiles. Numerous such alterations and modifications may be made in my invention without departing from the spirit and scope of the following claims.

What is claimed is:

1. A method for draining oil from an automobile engine to remove residual oil mixed with contaminants, said engine including an ignition circuit, an oil reservoir, oil pump means, an oil filter, first conduit means connecting said oil reservoir to said oil filter and having a distal opening adjacent said oil filter, and second conduit means connecting said oil filter to said engine;

said method comprising the steps of:

(a) draining oil from said reservoir;

(b) removing said oil filter to expose the distal opening in said first conduit means;

(c) fastening an adapter to said opening to preclude spillage of oil expelled therethrough and to preclude carriage of such oil through said second conduits means said adapter being characterized in that it comprises a disc having a gasket affixed to an inner surface thereof;

(d) interrupting said ignition circuit to preclude ignition in said engine;

(e) adding clean oil to said oil reservoir; and (f) operating said oil pump means to drive clean oil through said first conduit means, thereby to expel residual oil held in said first conduit means through the distal opening therein and through the adapter to disposal.

2. An adapter for facilitating removal of residual oil from an automobile engine adapted to include an oil filter and having an oil filter support post, an oil reservoir, first conduit means extending between said oil reservoir and a distal opening in said first conduit means proximal to said support post, and second conduit means for carrying oil from an oil filter to said engine; said adapter comprising shunt means comprising a disc cooperating with said first conduit means to preclude spillage of oil expelled through said distal opening and to preclude carriage of such oil through said second conduit means, and a gasket affixed to an inner surface of said disc, duct means for delivering residual oil shunted through said first conduit means externally of said engine for disposal, and means for attaching said adapter to said support post.

3. The adapter of claim 2, wherein said adapter defines a through bore having screw threads, and said means for attaching said adapter to said support post comprises screw threads on said support post adapted to mate with corresponding screw threads in said through bore.

4. The adapter of claim 2, wherein said duct means comprises a flexible plastic hose having an open distal end portion.

5. The adapter of claim 4, wherein said duct means further comprises a plastic bag attached to said end portion.

* * * * *